US005407336A

United States Patent [19]

White

[11] Patent Number: 5,407,336

[45] Date of Patent: Apr. 18, 1995

[54] HYDRAULIC MOTOR

[75] Inventor: Jeffrey N. White, Hopkinsville, Ky.

[73] Assignee: White Hydraulics, Inc., Hopkinsville, Ky.

[21] Appl. No.: 169,365

[22] Filed: Dec. 20, 1993

[51] Int. Cl.[6] ..... F01C 1/02

[52] U.S. Cl. ..... 418/61.3; 408/102

[58] Field of Search ..... 418/61.3, 102

[56] References Cited

U.S. PATENT DOCUMENTS 3,087,436 4/1963 Dettlof et al. ..... 418/61.3

3,352,247 11/1967 Easton ..... 418/61.3

3,853,435 12/1974 Ogasahara et al. ..... 418/61.3

4,285,643 8/1981 White ..... 418/61.3

4,514,152 4/1985 Tagamatsu et al. ..... 418/61.3

*Primary Examiner*—Richard A. Bertsch

*Assistant Examiner*—Charles G. Freay

*Attorney, Agent, or Firm*—Lightbody & Lucas

[57] ABSTRACT

A fluid opening is disclosed on the head section of a drive shaft 30, such opening fluidically connected to the furthest away fluid port so as to draw fluid across the bearings of the device.

14 Claims, 5 Drawing Sheets

HYDRAULIC MOTOR

FIELD OF THE INVENTION

This invention relates to a new bearing lubrication loop for hydraulic devices and, more particularly in the preferred embodiment, a hydraulic motor having a main bearing for the input/output shaft.

BACKGROUND OF THE INVENTION

Gerotor hydraulic devices which can function either as a pump or as a motor are well known in the art. Typically, these gerotor devices include an input/output shaft which is supported to a housing through some sort of main bearing. This main bearing is subject to forces in a radial direction, for example due to the sidewards load on the end of the output shaft, and in an axial direction, for example due to the internal pressure within the device acting on the shaft like a piston. These forces cause the shaft to shift in respect to the housing, creating increased temperature and wear at these critical bearings. Manufacturers, recognizing this, have developed certain methods of providing a flow of fluid to the bearings in an attempt to resolve some of these problems. An example is the White Hydraulics Model RS hydraulic motor as described in U.S. Pat. No. 4,285,643, Rotary Fluid Pressure Device, the contents of which are included by reference. The embodiment of the White Model RS shown in this particular patent uses a radially extending passageway extending outwardly from the bearing in the housing and a bypass passageway in the rotating shaft in order to allow the thrust bearing to act as a small pump to force liquid from equal pressure areas across the bearing, thus cooling and lubricating the main seal and this bearing. While this lengthens the service life of the gerotor motor over one not having a thrust bearing pump, the volume of fluid passed through the thrust bearing is not subject to easy control. In addition, the amount of fluid is a function of rotational speed of the main shaft. Thus, while this use of a thrust bearing as a pump does lengthen the life of a gerotor motor, it does not completely remedy the problem. As customers for gerotor motors insist on smaller and smaller power packages, it is important to develop a way of lubricating the critical bearings without increasing the size of the gerotor motor. This present invention accomplishes this.

OBJECTS AND SUMMARY OF THE INVENTION

It is an object of the present invention to provide for a positive pressure differential across the main bearings for the device.

It is another object of the present invention to reduce the wear on the main bearings of the gerotor motor.

It is yet another object of the present invention to lower the temperature of the main bearing of the gerotor motor.

It is an object of the present invention to provide for a bearing lubrication loop in a gerotor motor.

It is another object of the present invention to control the pressure across the main bearings of the gerotor motor.

It is yet another object of the present invention to control the pressure flow through a hydraulic device.

It is still another object of the present invention to increase the service life of a gerotor motor.

It is yet a further object of the present invention to increase the efficiency of gerotor motors.

It is a further object of the present invention to simplify the construction of gerotor motors.

Other objects and a more complete understanding of the invention may be had by referring to the following description and drawings in which:

BRIEF DESCRIPTION OF THE DRAWINGS

The structure, operation, and advantages of the presently disclosed preferred embodiment of the invention will become apparent when consideration of the following description taken in conjunction with the accompanying drawings wherein.

DETAILED DESCRIPTION OF THE INVENTION

Figure 1:
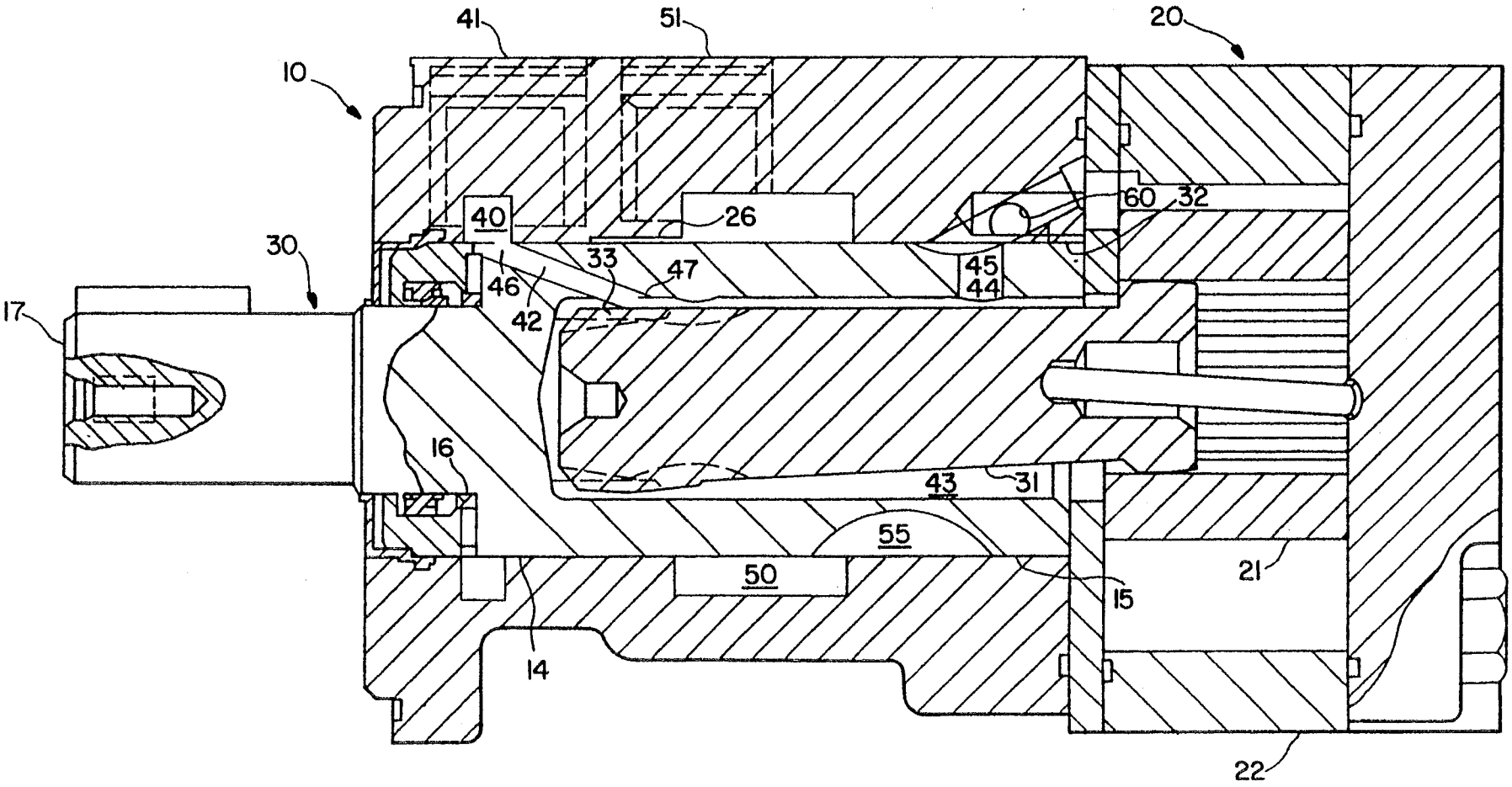
FIG. 1 is a longitudinal cross sectional view of a gerotor motor incorporating the invention of the application.

The preferred embodiment of the invention will first be described in reference to a White Hydraulics Model RS hydraulic motor, a description of which is included in the aforementioned U.S. Pat. No. 4,285,643.

The gerotor motor generally includes a housing 10, a gerotor structure 20, and a drive shaft 30.

The housing 10 serves to contain the fluid and moving parts of the gerotor motor as well as providing a means to mount the gerotor motor to an allied structure.

The gerotor structure 20 is the main operative power generating system for the gerotor motor. The particular gerotor structure described includes a rotating and orbiting rotor 21 inside a stationary stator 22.

The drive shaft 30 provides an input/output mechanical interconnection for the power present in the gerotor structure 20. The drive shaft is a cylindrical member which rotates in respect to the housing 10. A wobblestick 31 interconnects the orbiting rotor to the drive shaft 30 so as to pass power therebetween.

The drive shaft in addition is the main operative valve for the gerotor motor. For this to occur, there is a first fluid passage 40 and a second fluid passage 50 which are located surrounding the outer circumference of the drive shaft 30. These fluid passages 40, 50 are interconnected to the ports 41, 51 for constant communication in respect thereto. The first fluid passage 40 is interconnected by a hole or series of holes 42 to the inside diameter 43 of the drive shaft and thence through a second series of holes 44 to a first set of valving passages 45 located spaced circumferentially around the outer circumference of the drive shaft 30 next to a series of valving openings 60. The second fluid passage 50 is directly interconnected to a series of semi circular valving passages 55, which valving passages are located on the external surface of the drive shaft 30 in alternation with the valving passages 45, again in the area immediately adjacent or inside to the valving opening 60. Upon pressurization of either of the fluid ports 41, 51, these alternating valving passages 45, 55 selectively communicate to the valving opening 60 in order to operate the device. This operation is more completely described in the '643 patent.

The housing 10 serves to contain the pressure for the device and is a support structure for the drive shaft 30.

The shaft 30 is rotatively supported to the housing 10 through a pair of axially displaced radial bearings 14, 15. An axial thrust bearing 16 retains the shaft 30 within the housing against the axial pressures thereon. The radial bearings 14, 15 serve to rotatively support the shaft 30 to the housing 10, more particularly in respect to any sideward loads on the exterior end 17 of the shaft 30. The particular radial bearings disclosed are sleeve bearings. The axial thrust bearing 16 serves to dissipate to the housing 10 any, primarily pressure caused, axial forces on the shaft 30, thus preventing the shaft 30 from acting like a cylinder and moving outward of the housing 10. The particular axial bearing 16 disclosed is a radial thrust bearing. This bearing is more fully disclosed in U.S. Pat. No. 5,213,343, Shaft Seal With Support Member And Backing Ring, the contents of which are incorporated by reference. Due to the sideward loads on the exterior end 17 of the shaft 30 and the high pressures on the interior of the housing 10, the radial bearings 14, 15 and the axial bearing 16 are subjected to very high loads. This results in heat and wear at these critical bearing surfaces.

The invention of this present application is the location of relative high and low pressure areas within the housing 10 of the motor in order to insure a positive pressure differential across each main bearing 14, 15. In the preferred embodiment disclosed in FIG. 1, this is accomplished by locating the high pressure supply and low pressure return in two fluid passages 40, 50 on either side of the main radial bearing 14. The passages shown are rings extending 360° about the outer circumference of the shaft 30.

Two ports 41, 51 interconnect the motor to a source of high pressure and fluid return, with the direction of rotation of the motor dependent upon which port is pressurized. (The motor can also be utilized as a pump by connecting the shaft 30 to a source of power in a known manner.) In the customary rotary fluid pressure device such as that shown in the '643 patent, the two ports are located symmetrically in respect to the housing, in the '643 patent laterally side by side. These fluid ports then close connect to the valving in the shaft 30 approximately at the middle point between the radial bearings. Due to this and the location of the various fluid passages in the device, there is no significant pressure differential across both radial bearings. In contrast, in the present invention, the ports 41, 51 connect to two fluid passages 40, 50 asymmetrically located in respect to the shaft 30. This is accomplished by locating the fluid passage 40 of one port 41 on the opposite side of the main radial bearing 14 from the fluid passage 50 of the other port 51, each fluid passage being adjacent to the outer circumferential surface of the shaft 30. With this orientation, no matter which fluid port 41, 51 is pressurized, there will be a relatively high pressure area on one side of each bearing 14, 15 and a low pressure area on the other.

Due to the clearances between the outer surface of the shaft 30 and the housing 10, there will thus also be a fluid flow along such outer surface between the fluid passages 40, 50. This serves to lubricate the main radial bearing 14 which is located between the fluid passages 40, 50. To facilitate this movement, a small enlarged section 26 is milled into the interior of the housing 10. This serves to reduce the distance that the fluid must traverse between the fluid passages 40, 50. While this in turn reduces the sealing effect, which sealing effect is due to the small clearances between the exterior surface of the shaft 30 and the housing 10, under certain circumstances (high side loads) the lowered volumetric efficiency is paid for by increased service life. (A similar effect could be accomplished by milling small slots or a reduced diameter section in the shaft 30 inward of this point, etc.)

The interior bearing 15 at the interior end 32 of the shaft 30 is lubricated by the passage of fluid between: 1) the alternating valving passages 45, 55 radially around the outer circumference of the shaft 30 in combination with; 2) the leakage around the interior end 32 of the shaft between the alternating valving passage 55 (which is interconnected to the port 51) to or from the interior of the shaft 30 (which is interconnected to the port 41). This lubricates the radial bearing 15 for the device. As this bearing 15 is subject to less sideward radial loads than the radial bearing 14, the differing fluid flow at this location (i.e., at the location of bearing 15 versus bearing 14) is not of any significance.

A multiplicity of holes 42 serve to interconnect the fluid from the fluid passage 40 to the interior or inside diameter 43 of the shaft, thus interconnecting the port 41 to one set of alternating valving passages 45, 55 in the device, which valving passages 45, 55 cooperate with the valving opening 60 in the housing 10 to valve the device in a known manner.

The holes 42 in the preferred embodiment are located to provide additional lubrication for the device. Specifically, the entrance opening 46 for the holes 42 is located immediately adjacent to the axial bearing 16. This location serves to insure a steady flow of high volume fluid past this axial bearing 16, thus lubricating same through incidental flow. If desired, a more direct flow could be provided by having one or more of these entrance openings 46 to the holes extend from the inside of the bearing 16. This would increase fluid flow through the bearing.

The exit opening 47 of the holes 42 is located immediately adjacent to the wobblestick drive connection 33. Again, the passage of this high volume of fluid past this wobblestick drive connection 33 serves to lubricate and cool this critical connection. Again one or more of the exit openings could be moved from this point to bypass this location.

Note that, in the described preferred embodiment, the two main bearings 14, 15 are sleeve bearings. This type of bearing inherently restricts fluid flow across it due to the limited clearance between shaft and housing. Other types of bearings could also be utilized with the invention with some sealing adaptation to restrict fluid flow therethrough in order to provide for the pressure differential limited flow across the bearing while still providing a sufficient fluid flow separation between the two fluid passages (i.e., since the fluid flow across the bearing reduces the volumetric efficiency for the device, this flow should be preferably restricted to that necessary to cool and lubricate the bearing).

Figure 2:
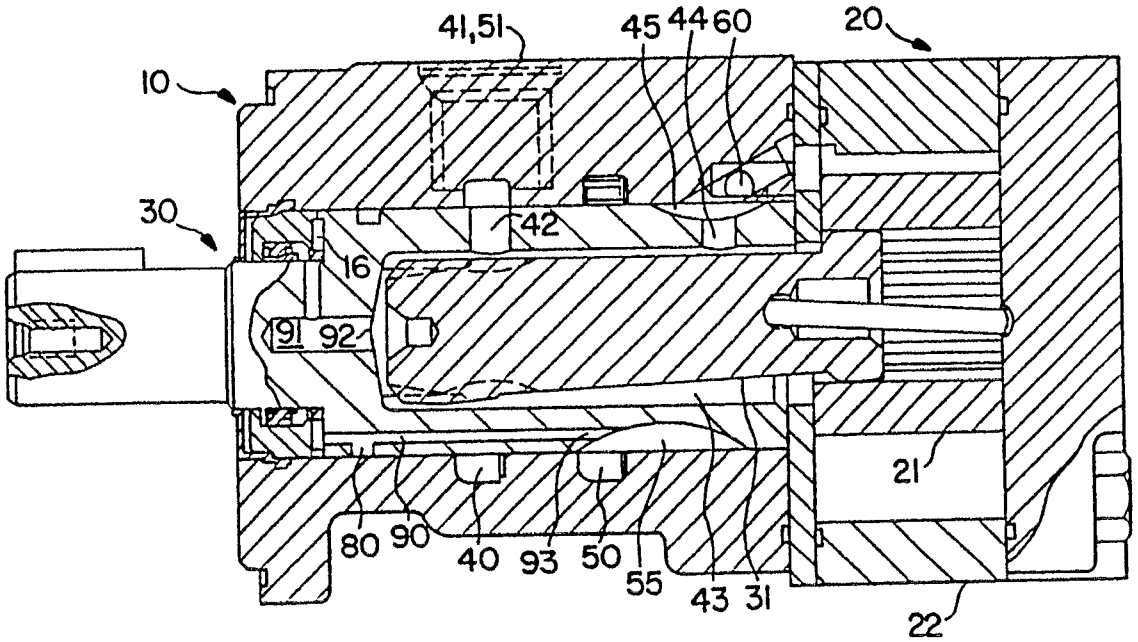
FIG. 2 is a cross sectional view of a hydraulic motor incorporating a modified version of the invention of the application.
Figure 3:
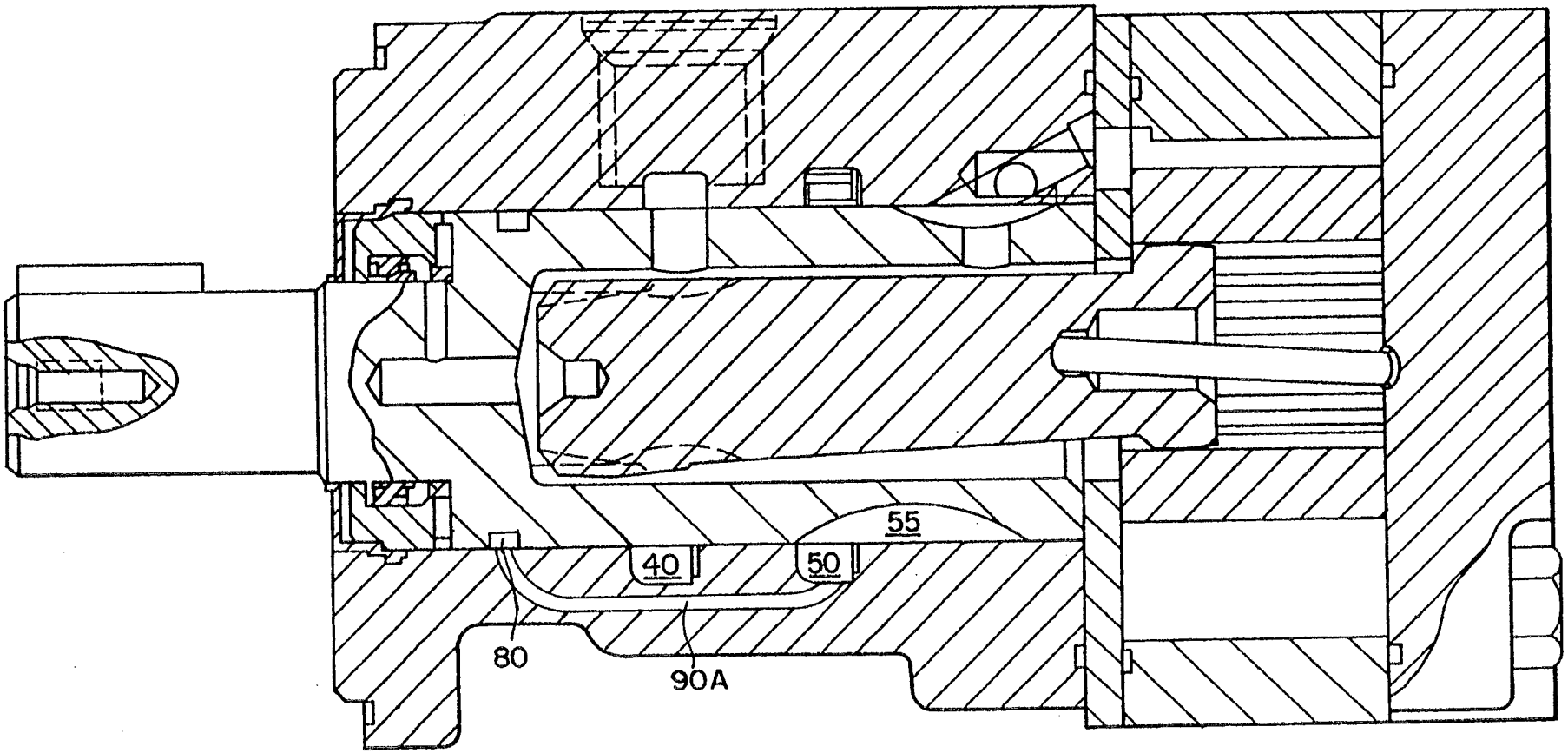
FIG. 3 is a cross sectional view like FIG. 2 of an alternate embodiment of the invention.

The location of relative high and low pressure areas within the housing of the motor in order to insure a positive pressure across main bearings can be provided in other ways as well, for example by a fluid opening 80, which opening is located at the head end of the drive shaft 30 generally neighboring the thrust bearing 16 (FIG. 2). A crossover passage 90 interconnects the fluid opening 80 to the second fluid passage 50. This crossover passage 90 can be located in the shaft (FIG. 2), in the housing (passage 90*a*; FIG. 3), or otherwise as desired. A second passage 91 located in the drive shaft 30 fluidically interconnects the inside diameter of the thrust bearing 16 to the first fluid passage 40 through the interior 43 of the drive shaft 30.

The fluid opening 80 is located on the opposite side of the first fluid passage 40 from the second fluid passage 50 to which it is interconnected by the crossover passage 90. For ease of construction, the passage 90 in FIG. 2 is drilled and then plugged while the passage 90*a* in FIG. 3 is a cast core finger. This fluid opening 80 by being in this location allows the passage of fluid between the first fluid passage 40 towards (or away from) the head end of the drive shaft 30. This passage of fluid lubricates the main sleeve bearing between the drive shaft 30 and the housing 10 at this location, thus insuring a constant flow of fluid through this critical area. Note that it is preferred that this fluid opening 80 be located such that it does not structurally weaken the critical leading axial thrust bearing surface of the shaft. This is especially so if the fluid opening 80 is a ring channel extending 360° about the circumference of the drive shaft 30 as shown in the preferred embodiment. (The opening 80 could be a hole, a series of spaced holes, or other type of opening if desired. It could also be located in the housing instead of the shaft if desired.)

In addition to fluid passing to/from the first fluid passage 40 to the fluid opening 80 along the outer circumference of the shaft 30, fluid also passes to/from the interior 43 of the shaft 30 along the passage 91 through the thrust bearing 16 to/from the fluid opening 80. This flow cools and lubricates the thrust bearing 16 (as well as part of the main sleeve bearing 14 for the head end of the shaft). Further, again fluid is circulated about the interior bearing 15 in the manner previously described in respect to FIG. 1. This lubricates this bearing 15.

In that the flow to/from the opening 80 is pressure induced, the flow occurs irrespective of the speed of rotation of the shaft 30, or which port 41, 51 is pressurized.

Figure 4:
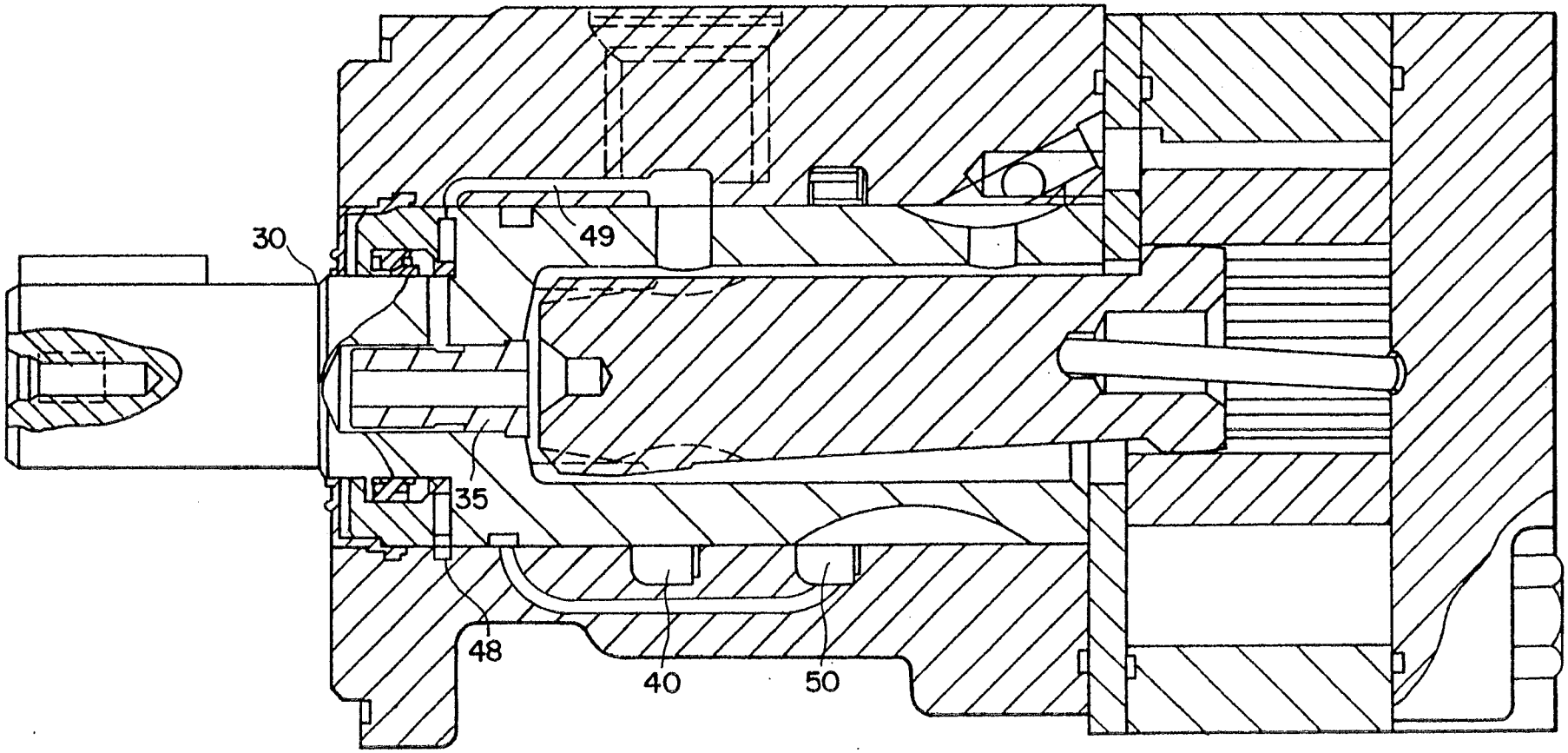
FIG. 4 is a cross sectional view like FIG. 3 of the modified alternate embodiment of the invention; and, FIG. 5 is a cross sectional view of another hydraulic motor incorporating the invention of the application.

A further modification to this fluid opening 80 embodiment would be the inclusion of a separate ring or series of holes 48 at the head end of the shaft 30, which ring 48 is somehow fluidically interconnected to the first fluid passage 40 (via a core cast finger 49 for example as shown in FIG. 4). This ring 48 would allow for better and/or separate control of the fluid through the thrust bearing 16 and the main bearing 14. In the example shown, the flow over main bearing 14 is controlled primarily by the clearance between the shaft 30 and housing 10 while the flow over the bearing 16 is controlled primarily by the clearance between a plug 35 and the inner diameter of a surrounding cavity in the shaft 30.

Although the invention has been described in its preferred embodiment with a certain degree of particularity, it is to be understood that numerous changes can be made without deviating from the invention as hereinafter claimed.

For example, although the crossover passage means 90 is shown extending in the drive shaft 30, the importance is that the fluid opening 80 is interconnected to the second fluid passage 50. This interconnection could occur in the drive shaft 30 as shown, in the housing 10, or in a combination thereof as desired. Similarly in respect to passage 48 in respect to the first fluid passage 40.

An additional example, although the crossover passage 90 is shown in FIG. 2 as a plugged hole drilled parallel to the axis of the drive shaft 30, the crossover passage 90 could open to the end of the shaft, even as a ring channel in such surface extending 360° about the axis of the drive shaft 30. This would increase the fluid flow across the thrust bearing in respect to fluid flow across the main bearing. A simple slot cut in the outer circumference of the enlarged diameter head section of the drive shaft 30 with such cut interconnected to the fluid opening 80 would also serve to increase fluid flow across the thrust bearing. This increased flow may be desirable under certain conditions.

In all embodiments, by altering dimensions, number, and location of holes and rings and by adding/removing restrictors, the fluid flow across the thrust bearing and main bearing can be separately or in combination controlled.

Figure 2A:
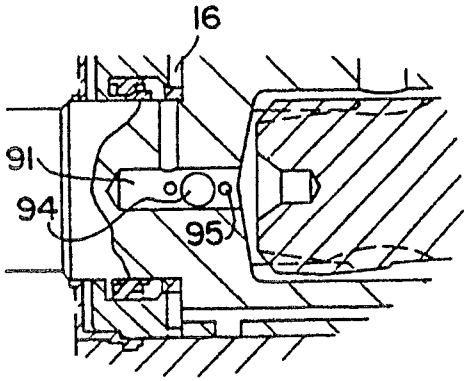
FIG. 2A is a cross sectional view detailing the ball restrictor.

Note in addition in respect to any passage, a restrictor could be located anywhere in the entire length of the interconnect (i.e., from point 92 to point 93 for passage 90 in the preferred embodiment disclosed) if desired in order to control fluid flow and/or to in order not unduly compromise the volumetric efficiency of the motor; any fluid which passes directly through the crossover passage causes a parasitic drain of the operating fluid for the motor. (Passage of fluid through some opening, such as 80, is normally self limited by the small selected clearances, such as between the shaft 30 and the surrounding housing 10 in respect to 80.) A particular restrictor could be a small ball 94 located in a hole having a slightly larger diameter (FIG. 2A). A pin or pins 95 would hold the ball against forces which might otherwise tend to cause such ball to pass down the passage during pressurization. This use of a ball restrictor allows for the precise dimensioning of the apparent effective size of a crossover passage, thus providing for a high measure of control on the volume of fluid passing through this passage. Varying the clearance between the shaft and housing could also control the flow of fluid. Due to the fact that this controlled fluid in addition directly passes over the bearings, the flow of fluid would further serve to cool and lubricate these bearings and adjacent seal. This lubrication and cooling significantly extends the service life of these components.

Figure 5:
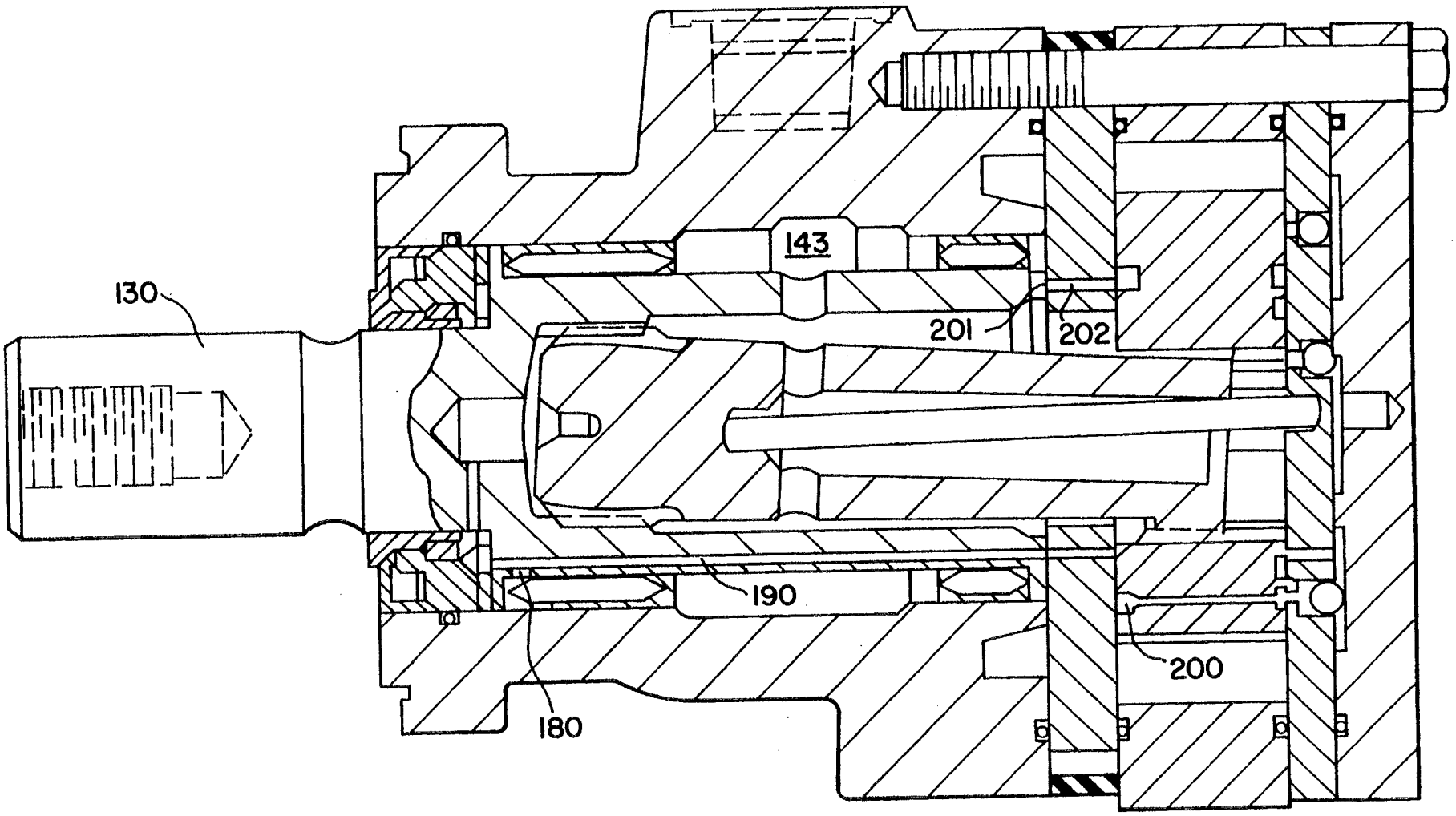

Similarly, although the invention is disclosed in the White Model RS hydraulic motor, it can be incorporated in other types of hydraulic motors as well. For example referring to FIG. 5, to include the invention in the White Model RE gerotor motor, a typical example of which is disclosed in U.S. Pat. No. 4,717,320, the contents of which are incorporated herein, one could extend the crossover passage 190 through the entire length of the shaft 130 so as to interconnect with a small ring channel 201 located immediately off of the interior end of such shaft. This ring channel 201 is itself interconnected through a series of holes 202 to the outer valving passage 200 in the rotor. Again, this interconnects the bypass fluid opening 180 to a differing fluid port than the interior of 143 of the gerotor motor, thus providing for the pressure differential fluid circulation such as that described in respect to the White Model RS motor. Again, the aggregate interconnection between the fluid passage 300 and the interior 143 of the drive shaft is selected so as to provide for a proper amount of lubrication and cooling without unduly compromising the volumetric efficiency of the overall gerotor motor. The invention could be incorporated into other gerotor motor designs as well.

Other modifications are also possible.

What is claimed:

1. In a gerotor motor having one passage for interconnection with high pressure supply and a second passage for interconnection with low pressure return and a main bearing for the drive shaft, said main bearing having two sides, the improvement of means to provide fluid from the high pressure supply from one of the passages to one side of the bearing and means to provide fluid from the low pressure return from the other passage to the other side of the bearing.

2. The improved motor of claim 1 characterized in that the passages are interconnected to two fluid rings respectively, with one said fluid ring having high pressure supply being located on one side of the main bearing and the other said fluid ring having low pressure return being located on the other side of said main bearing.

3. The improved motor of claim 2 wherein the motor has a shaft with an interior and characterized by the addition of holes, said holes being in the shaft, and said holes connecting either said one or said second passage to the interior of the shaft.

4. The improved motor of claim 3 wherein the motor has an axial bearing and characterized in that said holes have an entrance, said entrance to said holes being located adjacent to the axial bearing for the motor.

5. The improved motor of claim 4 wherein there is a wobblestick drive connection on the interior of the shaft and characterized in that said holes have exit openings, said exit openings being located adjacent to said wobblestick drive connection to cool and lubricate same.

6. The improved motor of claim 1 wherein the motor has a shaft rotatively mounted in a housing, such shaft have an interior end and an exterior surface with a circumference characterized by a second radial bearing between the shaft and housing, said second radial bearing being located substantially near the interior end of the shaft, and said shaft having alternating valving passages on the exterior surface thereof, characterized by the addition of leakage passages, said leakage passages being between said alternating valving passages around the circumference of the shaft as well as around the interior end of the shaft to the interior of the shaft.

7. In a hydraulic motor having a housing and radial fluidic communication between first and second fluid passages located sequentially axially in the housing and first and second fluid passages respectively in a cylindrical member drive shaft rotatively mounted within the housing, the improvement of the motor having a fluid opening, said fluid opening being located in one of the cylindrical member drive shaft or the housing on the opposite side of the respective first fluid passage from the respective second fluid passage, a crossover passage means and said crossover passage means interconnecting said fluid opening to one of said second fluid passages.

8. The motor of claim 7 wherein the cylindrical member drive shaft has an outer surface and said fluid opening is located at the outer surface of the cylindrical member drive shaft.

9. The motor of claim 7 characterized in that the fluid opening is a ring channel.

10. The motor of claim 8 characterized in that said crossover passage means is located in the cylindrical member drive shaft.

11. The motor of claim 7 wherein the motor has a thrust bearing on the opposite side of the first passage in the housing from the second passage in the housing and characterized in that said crossover passage means includes a second opening adjacent to the thrust bearing, a passage, said passage being adjacent to the thrust bearing, means to connect said passage to one of the first fluid passage and means to restrict the volume of fluid able to pass through said crossover passage means.

12. In a hydraulic motor having a housing and fluidic communication between first and second side by side fluid passages in the housing and first and second fluid passages respectively in a cylindrical member drive shaft having an outer surface rotatively mounted within the housing, the improvement of the motor having a fluid opening, said fluid opening being located at the outer surface of the cylindrical member on the opposite side of the first fluid passage from the second fluid passage in the cylinder, a crossover passage means and said crossover passage means interconnecting said fluid opening to one of the second fluid passages.

13. The motor of claim 12 characterized in that the fluid opening is a ring channel.

14. The motor of claim 12 characterized in that said crossover passage means is located in the cylindrical member drive shaft.

* * * * *